United States Patent [19]

Onoue

[11] Patent Number: 5,026,309

[45] Date of Patent: Jun. 25, 1991

[54] CASING ARRANGEMENT FOR MARINE PROPULSION UNIT

[75] Inventor: Akihiro Onoue, Hamamatsu, Japan

[73] Assignee: Sanshin Kogyo Kabushiki Kaisha, Hamamatsu, Japan

[21] Appl. No.: 473,222

[22] Filed: Jan. 31, 1990

[30] Foreign Application Priority Data

Feb. 1, 1989 [JP] Japan ..... 1-20748

[51] Int. Cl.[5] ..... B63H 21/26

[52] U.S. Cl. ..... 440/76; 440/89

[58] Field of Search ..... 440/76, 78, 89; 123/195 P

[56] References Cited

U.S. PATENT DOCUMENTS 2,549,477 4/1951 Kiekhaefer ..... 440/78

4,014,282 3/1977 Kollman ..... 440/89

*Primary Examiner*—Sherman Basinger

*Attorney, Agent, or Firm*—Ernest A. Beutler

[57] ABSTRACT

A sealing member is provided in a marine propulsion unit, which is interposed between adjoining surfaces of the driveshaft housing and lower unit of the propulsion unit and extends around an exhaust gas discharge passage formed in the lower unit to prevent exhaust gas from leaking out from between the driveshaft housing and lower unit.

14 Claims, 3 Drawing Sheets

CASING ARRANGEMENT FOR MARINE PROPULSION UNIT

BACKGROUND OF THE INVENTION

This invention relates to a casing arrangement for a marine propulsion unit, such as an outboard motor or the outboard drive portion of an inboard/outboard motor. More particularly, the invention pertains to an improved casing arrangement wherein packing means are provided between adjoining ends of the driveshaft housing and lower unit of the marine propulsion unit to prevent exhaust gases from leaking out from therebetween.

A typical marine propulsion unit, whether of the outboard motor or inboard/outboard motor type, generally includes an internal combustion engine and a lower casing. The lower casing is typically comprised of a driveshaft housing with an expansion chamber formed therein to which exhaust gases are delivered from the exhaust ports of the engine, and a lower unit connected to the driveshaft housing and having a passage for discharging exhaust gases from the chamber to the exterior through an outlet in the propeller.

The lower surface of the driveshaft housing and the upper surface of the lower unit are normally connected by bolts or other suitable connecting means. However, in this arrangement, any seal between the two surfaces and particularly around the exhaust gas discharge passage in the lower unit is effected only by the force of the adjoining surfaces abutting agsint each other. As ar result, engine exhaust gas can leak out of the casing from between the adjoining surfaces of the driveshaft housing and lower unit. In extreme cases, this leaking exhaust gas may corrode the paint layers and ground metal on the driveshaft housing and lower unit, causing the casing to look worn or weathered, and generally degrading the appearance of the propulsion unit. The high temperature of the leaking exhaust gas can also heat up the adjoining surfaces of the driveshaft housing and lower unit and in extreme cases may weaken and soften the surfaces, which in turn, tends to accelerate wear of the surfaces as a result of collisions against each other caused by engine vibration.

It is, therefore, a principal object of this invention to provide an improved casing arrangement which prevents exhaust gas from leaking out from the exhaust gas discharge passage and from between the adjoining surfaces of the driveshaft housing and lower unit.

It is a further object of this invention to prevent the paint layers and ground metal of the casing components from being corroded by leaking exhaust gas from between the mating surfaces of the driveshaft housing and lower unit.

It is yet a further object of this invention to prevent the reduction in pressure durability of the adjoining surfaces of the driveshaft housing and lower unit as a result of leaking exhaust gas from therebetween.

SUMMARY OF THE INVENTION

This invention is adapted to be embodied in a marine propulsion unit that is comprised of an internal combustion engine, a driveshaft housing, and lower unit including propulsion means. The engine includes an exhaust port for discharging exhaust gas from the engine. An expansion chamber is formed within the driveshaft housing, and conduit means formed within the engine and the driveshaft housing convey exhaust gas from the exhaust port to the expansion chamber. An exhaust gas discharge passage is formed in the lower unit for discharging exhaust gas to the exterior from the expansion chamber. In accordance with the invention, packing means, preferably in the form of a sealing member, is interposed between the adjoining ends of the driveshaft housing and lower unit around the discharge passage to prevent exhaust gas from leaking out from between the driveshaft housing and the lower unit.

DETAILED DESCRIPTION OF THE PREFERRED EMBODIMENTS

Figure 1:
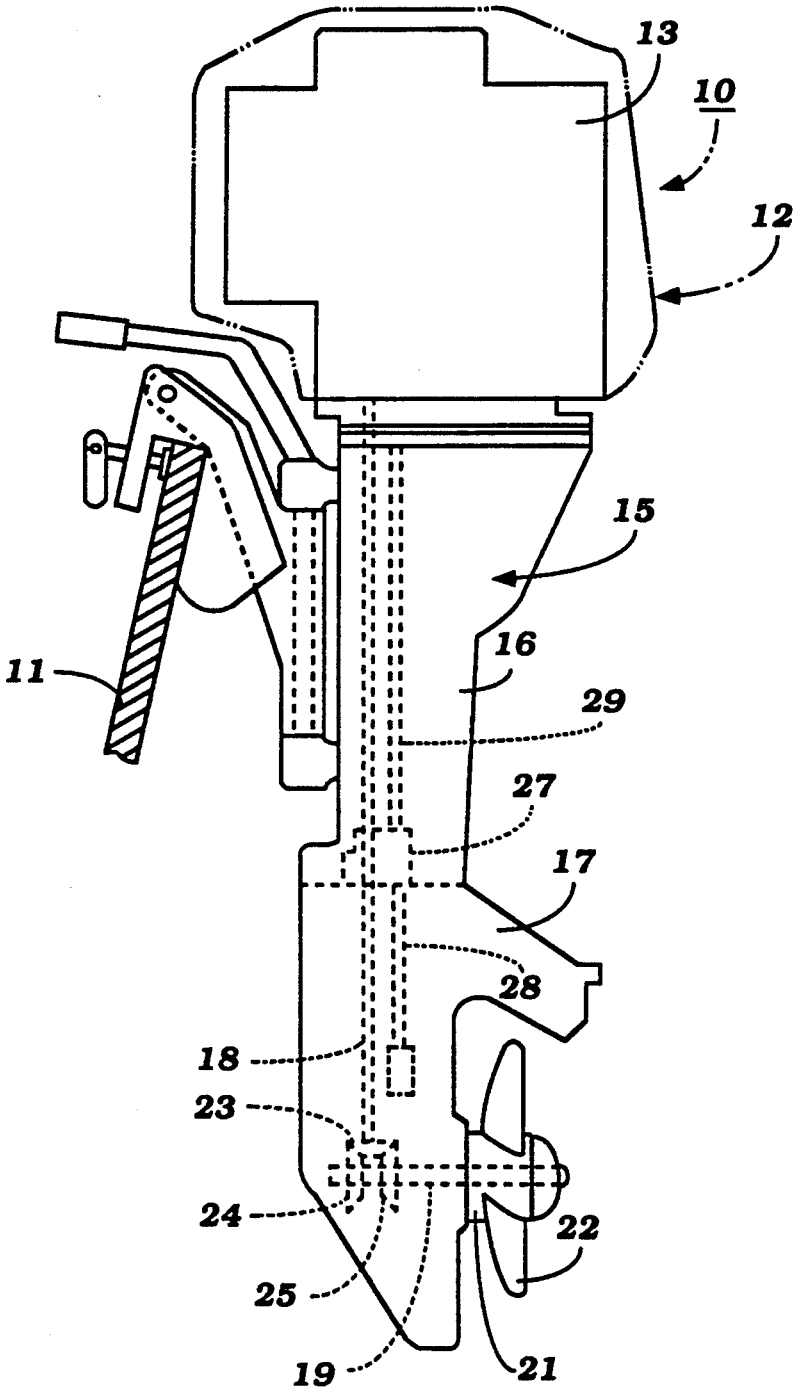
FIG. 1 is a side elevational view of an outboard motor attached to the transom of an associated watercraft and constructed in accordance with an embodiment of the invention.

Referring first to FIG. 1, a marine propulsion unit in the form of an outboard motor constructed in accordance with an embodiment of the invention is identified generally by the reference number 10 and is pivotally attached to the transom 11 of an associated watercraft. The outboard motor 10 is comprised of a powerhead, outlined in phantom in FIG. 1 and identified generally by the reference numeral 12. The powerhead 12 includes an internal combustion engine 13, which may be of any known type.

Since the invention deals primarily with the casing arrangement of the marine propulsion unit the specific details of the construction of the internal components of the engine 13 are not believed to be necessary to understand the invention. For that reason, further description of the basic engine components is not believed to be necessary.

One form of engine 13 with which the invention may be embodied is a multi-cylinder, two cycle, crankcase compression type that is comprised of a cylinder block having cylinder liners that define cylinder bores in which pistons are supported for reciprocation. The cylinder liners are provided with exhaust ports which typically open into an exhaust manifold formed within the cylinder block. The exhaust manifold is surrounded by a cooling jacket which contains coolant and which cools the exhaust manifold.

Figure 2:
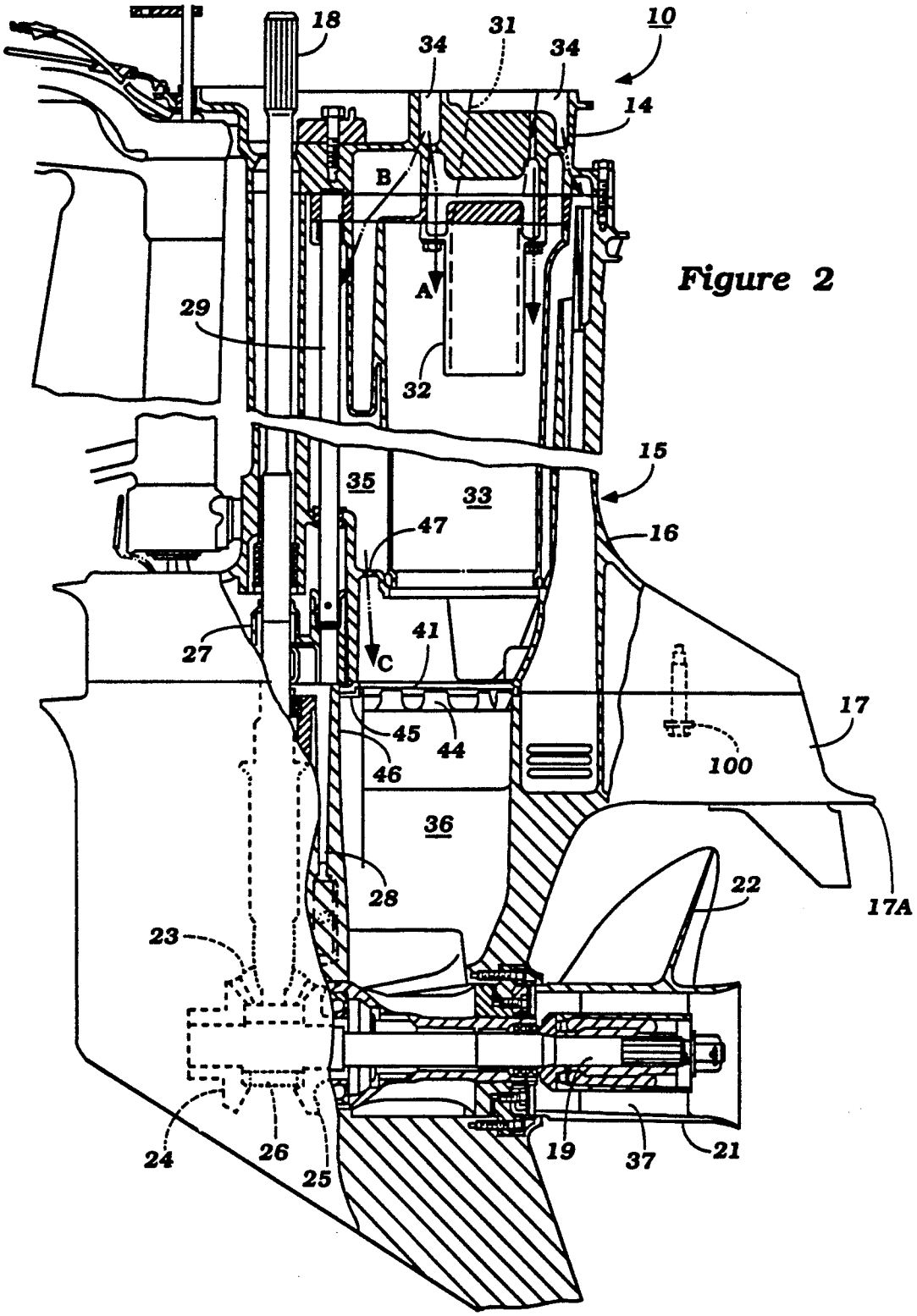
FIG. 2 is a side view of the casing including the driveshaft housing and lower unit of a marine propulsion unit with portions broken away and other portions shown in section, constructed in accordance with an embodiment of the invention.

Referring now to FIGS. 1 and 2, a spacer plate 14 is interposed between the powerhead 12 and a casing 15 which includes a driveshaft housing 16 and a lower unit 17. The spacer plate 14 supports the engine 13 and also provides a closure for the upper end of the driveshaft housing 16. A driveshaft 18 is driven by the pistons of the engine 13 in a known manner and is rotatably journaled about a vertically extending axis within the driveshaft housing 16.

The driveshaft 18 depends into the lower unit 17 which is positioned beneath and connected to the driveshaft housing 16 by means of bolts 100. The upper surface of the lower unit 17 which adjoins and is connected to the lower surface of the driveshaft housing 16 is approximately two (2) inches above an anti-cavitation plate 17A. Contained within the lower unit 17 is a forward, neutral, reverse transmission of a known type for driving a propeller shaft 19. The propeller shaft 19 is suitably journaled within the lower unit 17 and has affixed to it a propeller 21 having blades 22 for powering an associated watercraft.

The transmission includes a driving bevel gear 23 that is affixed to the lower end of the driveshaft 18. This driving bevel gear 23 is in mesh with a pair of counter-rotating bevel gears 24 and 25 which are journaled on the forward end of the propeller shaft 19. The bevel gear 24 is journaled by means of a thrust bearing that is affixed within the lower unit 17. The bevel gear 25 is journaled by means of a ball bearing which is supported within a bearing carrier. A dog clutching sleeve 26 is slidably supported on the forward end of the propeller shaft 19 by means of a splined connection. The dog clutching sleeve 26 has oppositely facing dog clutching teeth that are adapted to engage the corresponding dog clutching teeth on the gears 24 and 25 for rotatably coupling either of these gears to the propeller shaft 19 so as to drive the propeller 21 in selected forward or reverse directions.

A water pump 27 is contained within the lower portion of the driveshaft housing 16 and is driven by the driveshaft 18. The water pump 27 draws water from the body of water in which the watercraft is operating through an inlet and conduit 28 in the lower unit 17 and delivers it to the cooling jacket of the engine 13 through a conduit 29. The water is also delivered to a cooling jacket which surrounds the exhaust manifold for cooling the same.

Referring now to FIG. 2, the spacer plate 14 is formed with an exhaust passageway 31 formed within the engine 13 and driveshaft housing 16 that receives exhaust gas or gases that have been discharged from the engine exhaust ports and collected in the exhaust manifold. An exhaust pipe 32 is affixed to the underside of the spacer plate 14 and formed within the driveshaft housing which defines a passageway and which is in communication with exhaust passageway 31. The exhaust pipe 32 depends into an exhaust gas expansion chamber 33 that is formed within the driveshaft housing 16. The exhaust passageway 31 and exhaust pipe 32 act to convey exhaust gas from the engine exhaust ports to the expansion chamber 33.

Water is also delivered to the expansion chamber 33 from the engine cooling jacket through restricted orifices 34. The water then flows through passage A in proximity to the exhaust pipe 32 to cool the pipe 32 and also flows into water jacket 35 through passage B around the exhaust gas expansion chamber 33 for cooling of the chamber 33 and to assist in silencing exhaust noises.

The expansion chamber 33 is formed with a restricted outlet neck that mates with a first exhaust gas discharge passage 36 formed in the lower unit 17. The first discharge passage 36 communicates with a second exhaust gas discharge passage 37 formed in the hub of the propeller 21 for high speed underwater exhaust gas discharge. Alternatively, any of the other known types of underwater exhaust gas discharges may be employed for discharging exhaust gas.

In accordance with the invention, packing means are provided in the form of a sealing member 41 interposed between the adjoining surfaces of the driveshaft housing 16 and lower unit 17. The sealing member 41 extends around and seals the first exhaust gas discharge passage 36 so as to prevent exhaust gas from leaking out from between the driveshaft housing 16 and lower unit 17.

Figure 3:
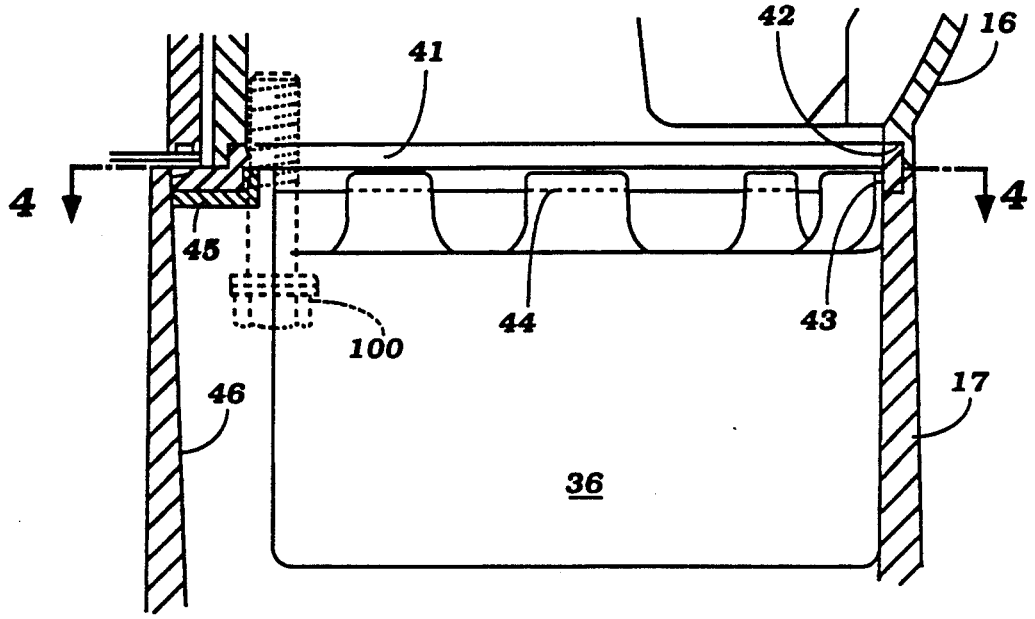
FIG. 3 is an enlarged cross-sectional view of the adjoining ends of the driveshaft housing and lower unit of FIG. 2.
Figure 4:
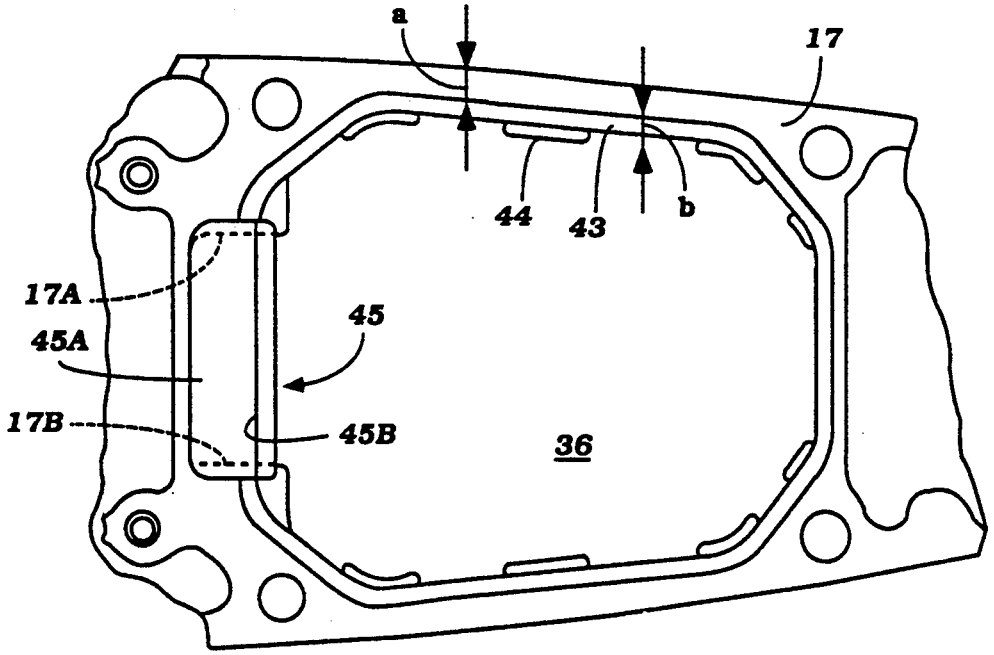
FIG. 4 is a top view of the lower unit taken along line IV—IV of FIG. 3 with the sealing member removed.

Referring now to FIGS. 2, 3 and 4, the driveshaft housing 16 has a first stepped portion 42 formed on the inner periphery of its lower end which adjoins the lower unit 17. A second stepped portion 43 is formed on the inner periphery of the upper end of the lower unit 17 which adjoins the driveshaft housing 16. These stepped portions 42 and 43 have a width (b) and define a space within which the sealing member 41 is positioned. This leaves a width (a) on the outer periphery portions of each of the adjoining surfaces of the driveshaft housing 16 and lower unit 17 for directly abutting against each other.

The lower unit 17 has a plurality of ribs 44 formed inside its stepped portion 43 for securely holding the sealing member 41 in place. An L-shaped shelf portion 45 is mounted on supporting steps 17A and 17B of lower unit 17 which extend inwardly into the first exhaust gas discharge passage 36 on the front side of the lower unit 17. This L-shaped shelf portion 45 has a horizontal member 45A seated on supporting steps 17A and 17B and a member 45B which extends vertically and upwardly from the inner periphery of horizontal member 45A. This L-shaped shelf portion 45 compensates for the offset between the driveshaft housing 16 and lower unit 17, and at the front side of the first exhaust gas discharge passage 36 caused by the casting draft of passage wall 46.

On the front side of the lower unit 17, the sealing member 41 is seated on the inner periphery of horizontal member 45A outside of member 45B and is prevented from moving further inward by vertically and upwardly extending member 45B. Thus, the L-shaped shelf portion 45 assists in securely holding the sealing member 41 in place, and also facilitates installation of the sealing member 41 and assembly of the casing components 16 and 17.

The sealing member 41 is cooled by water discharged through restricted orifice 47 at the bottom of water jacket 35. The . water flows through passage C and is distributed over the sealing member 41. Cooling water discharged through passage A, as well as outside water around the adjoining portions of the driveshaft housing 16 and lower unit 17 also contributes in cooling the sealing member 41 to prevent it from being deteriorated by the heat of the exhaust gas.

The sealing member 41 interposed between the driveshaft housing 16 and lower unit 17 provides an improved casing arrangement which prevents exhaust gas from leaking out from the first exhaust gas discharge passage 36 and from between the adjoining surfaces of the driveshaft housing 16 and lower unit 17. This sealing member 41 and improved casing arrangement also prevents the paint layers and ground metal of the casing components 6 and 17 from being corroded by leaking exhaust gases from between the mating surfaces of the driveshaft housing 16 and lower unit 17. The sealing member 41 and improved casing arrangement of this invention further prevents the reduction in pressure durability of the adjoining surfaces of the driveshaft housing 16 and lower unit 17 as a result of leaking exhaust gas therebetween.

It should be readily apparent from the foregoing description that the described and illustrated invention is highly effective in accomplishing the above objectives. It is to be understood, however, that the foregoing description is that of preferred embodiments of the invention. Various changes and modifications may be made without departing from the spirit and scope of the invention, as defined by the appended claims.

I claim:

1. A marine propulsion unit including an internal combustion engine having an exhaust port for discharging exhaust gas from said engine, said propulsion unit comprising, a driveshaft housing having a chamber formed therein, a lower unit connected to said driveshaft housing including propulsion means driven by said engine, conduit means formed within said engine and said drivehsaft housing for conveying exhaust gas from said exhaust port to said chamber, an exhaust gas discharge passage in said lower unit for discharging exhaust gas from said chamber to the exterior, and packing means interposed between adjoining ends of said drivehsaft housing and said lower unit surrounding said discharge passage to prevent exhaust gas from leaking out from between said driveshaft housing and said lower unit said adjoining ends having an outer periphery and an inner periphery, but wherein at least a portion of the adjoining ends of the said driveshaft housing and said lower unit forwardly of the exhaust discharge passage abut directly against each other.

2. A marine propulsion unit as recited in claim 1, wherein said packing means comprises a sealing member.

3. A marine propulsion unit as recited in claim 2, wherein said chamber is an expansion chamber.

4. A marine propulsion unit as recited in claim 3, wherein said driveshaft housing has a first stepped portion formed on the inner periphery of its lower end adjoining said lower unit and said lower unit has a second stepped portion on the inner periphery of its upper end adjoining said driveshaft housing, said sealing member being positioned within said stepped portions.

5. A marine propulsion unit as recited in claim 4, wherein said driveshaft housing and said lower unit abut against each. other at the outer peripheries of their adjoining ends.

6. A marine propulsion unit as recited in claim 5, wherein said lower unit has a plurality of ribs formed inside said second stepped portion for securely holding said sealing member in place.

7. A marine propulsion unit as recited in claim 6, wherein said lower unit includes a pair of supporting steps on the front side of said lower unit and an L-shaped shelf portion mounted on said supporting steps, said L-shaped shelf portion having a horizontal member supported on said supporting steps and a vertically extending member, said sealing member being seated on the inner periphery of said horizontal member outside of said vertically extending member.

8. A marine propulsion unit a recited in claim 1, wherein said chamber is an expansion chamber.

9. A marine propulsion unit as recited in claim 8, wherein said drivehsaft housing has a first stepped portion formed on the inner periphery of its lower end adjoining said lower unit and said lower unit has a second stepped portion on the inner periphery of its upper end adjoining said driveshaft housing, said packing means being positioned within said stepped portions.

10. A marine propulsion unit as recited in claim 9, wherein said driveshaft housing and said lower unit abut against each other at the outer peripheries of their adjoining ends.

11. A marine propulsion unit as recited in claim 10, wherein said lower unit has a plurality of rigs formed inside said second stepped portion for securely holding said packing means inplace.

12. A marine propulsion unit as recited in claim 11, wherein said lower unit includes a pair of supporting steps on the front side of said lower unit and an L-shaped shelf portion mounted on said supporting steps, said L-shaped shelf portion having a horizontal member supported on said supporting steps and a vertically extending member, said packing means being seated on the inner periphery of said horizontal member outside of said vertically extending member.

13. A marine propulsion unit as recited in claim 1, wherein said driveshaft housing and said lower unit abut directly against each other at the outer peripheries of their adjoining ends.

14. A marine propulsion unit as recited in claim 1, wherein said driveshaft housing and said lower unit abut directly against each other on the outer side of said packing means.

* * * * *